US007559664B1

(12) United States Patent
Walleman et al.

(10) Patent No.: US 7,559,664 B1
(45) Date of Patent: Jul. 14, 2009

(54) LOW PROFILE BACKLIGHTING USING LEDS

(75) Inventors: John V. Walleman, 40171 Spady St., Fremont, CA (US) 94538; Malan D. Rampton, Vienna, VA (US)

(73) Assignee: John V. Walleman, Fremont, CA (US)

( * ) Notice: Subject to any disclaimer, the term of this patent is extended or adjusted under 35 U.S.C. 154(b) by 362 days.

(21) Appl. No.: 11/020,110

(22) Filed: Dec. 27, 2004

(51) Int. Cl.
*F21V 9/16* (2006.01)
*G09F 13/04* (2006.01)
*G09F 13/20* (2006.01)

(52) U.S. Cl. ..... 362/84; 362/230; 362/236; 40/542; 40/564

(58) Field of Classification Search ..... 362/84, 362/97, 230, 231, 235–237, 240, 29, 30; 40/542, 543, 544, 564, 714, 716, 546
See application file for complete search history.

(56) References Cited

U.S. PATENT DOCUMENTS

| | | | | | |
|---|---|---|---|---|---|
| 3,700,880 | A | * | 10/1972 | Smith | 40/433 |
| 5,232,388 | A | * | 8/1993 | Danjell | 40/543 |
| 5,247,745 | A | * | 9/1993 | Valentino | 40/716 |
| 5,539,623 | A | * | 7/1996 | Gurz et al. | 40/564 |
| 5,697,175 | A | | 12/1997 | Schwartz | 40/552 |
| 5,759,671 | A | * | 6/1998 | Tanaka et al. | 40/543 |
| 5,775,791 | A | * | 7/1998 | Yoshikawa et al. | 362/625 |
| 5,977,901 | A | | 11/1999 | Fenner | 341/176 |
| 5,997,149 | A | | 12/1999 | Chu | 362/142 |
| 6,007,209 | A | * | 12/1999 | Pelka | 362/30 |
| 6,322,229 | B1 | | 11/2001 | Chan et al. | 362/85 |
| 6,325,524 | B1 | * | 12/2001 | Weber et al. | 362/245 |
| 6,352,359 | B1 | | 3/2002 | Shie et al. | 362/522 |
| 6,486,790 | B1 | | 11/2002 | Perlo et al. | 340/815.45 |
| 6,519,209 | B1 | | 2/2003 | Arikawa et al. | 368/242 |

(Continued)

FOREIGN PATENT DOCUMENTS

JP 8-7614 12/1996

OTHER PUBLICATIONS

Yourii Martynov et al., "High-efficiency slim LED backlight system with mixing light guide", SID 03 Digest, 43.3/Martynov, pp. 1-3.

(Continued)

*Primary Examiner*—Alan Cariaso
(74) *Attorney, Agent, or Firm*—Fish & Richardson P.C.

(57) ABSTRACT

A low profile backlighted display includes a translucent display piece having a viewable surface. A casing is configured expose at least a portion of the viewable surface. The display piece may have a perimeter, and the casing may conform generally to the perimeter of the display piece. An illumination cavity is configured within the casing and is behind the viewable surface of the display piece. A plurality of light emitting diodes (LEDs) are located within the illumination cavity. At least one of the LEDs may be configured to backlight the display piece, and one or more of the LEDs may be configured to emit essentially only non-visible light. A passive element may be configured to backlight the viewable surface when excited by non-visible light from the non-visible light LEDs. The plurality of LEDs and the passive element collectively provide an essentially uniform back light illumination of the viewable surface.

6 Claims, 12 Drawing Sheets

U.S. PATENT DOCUMENTS

| | | | | |
|---|---|---|---|---|
| 6,523,976 | B1 | 2/2003 | Turnbull et al. | 362/231 |
| 6,536,914 | B2 * | 3/2003 | Hoelen et al. | 362/231 |
| 6,566,689 | B2 | 5/2003 | Hoelen et al. | 257/89 |
| 6,595,671 | B2 * | 7/2003 | Lefebvre et al. | 362/545 |
| 6,597,018 | B2 | 7/2003 | Nei | 257/79 |
| 6,614,419 | B1 | 9/2003 | May | 345/156 |
| 6,650,894 | B1 | 11/2003 | Berstis et al. | 455/420 |
| 6,652,128 | B2 | 11/2003 | Misaras | 362/488 |
| 6,661,910 | B2 | 12/2003 | Jones et al. | 382/135 |
| 6,663,254 | B2 | 12/2003 | Ohsumi | 362/600 |
| 6,663,262 | B2 | 12/2003 | Boyd et al. | 362/296 |
| 6,666,567 | B1 | 12/2003 | Feldman et al. | 362/237 |
| 6,686,847 | B1 | 2/2004 | Mittler | 340/815.4 |
| 6,799,865 | B2 * | 10/2004 | Ellens et al. | 362/240 |
| 6,840,652 | B1 * | 1/2005 | Hymer | 362/235 |
| 6,905,227 | B2 * | 6/2005 | Wu | 362/240 |
| 7,101,061 | B2 * | 9/2006 | Nagai et al. | 362/247 |
| 7,107,712 | B2 * | 9/2006 | Mueller | 40/546 |
| 2002/0190956 | A1 | 12/2002 | Klein et al. | 345/169 |
| 2003/0048639 | A1 | 3/2003 | Boyd et al. | 362/296 |
| 2003/0067758 | A1 | 4/2003 | Shipman | 362/26 |
| 2003/0079387 | A1 | 5/2003 | Derose | 40/544 |
| 2003/0230045 | A1 | 12/2003 | Krause et al. | 52/786.13 |
| 2003/0230991 | A1 | 12/2003 | Muthu et al. | 315/307 |
| 2004/0042208 | A1 | 3/2004 | Wu | 362/245 |

OTHER PUBLICATIONS

Robert Scott West et al., "High Brightness Direct LED Backlight for LCD-TV", SID 03 Digest, 43.4/R. West.

EL Light, "ISO 9001:2000 Certificated Company", reprinted from http://www.elight.com.cn/encompany.htm, printed on May 25, 2004 (1 page).

EL Light, "Samples ISO 9001:2000 Certificated Company", reprinted from http://www.elight.com.cn/ensamples.htm, printed on May 25, 2004 (1 page).

EL Light, "EL Back Light used", reprinted from http://www.elight.com.cn/samples2.htm, printed on May 25, 2004 (1 page).

EL Light, "EL used on Building, Road Sign", reprinted from http://www.elight.com.cn/ensamples3.htm, printed on May 25, 2004 (2 pages).

EL Light, "What's New", reprinted from http://www.elight.com.cn/ennew.htm, printed on May 25, 2004 (2 pages).

Light Boxes, Backlit Display Frames, "Light Box—The Ultra-Thin Slim Jim", reprinted from http://www.pegasusassociates.com/BLslimjim.jsp, printed on May 25, 2004 (3 pages).

* cited by examiner

130

LOW PROFILE BACKLIGHTING USING LEDS

TECHNICAL FIELD

This disclosure relates to low profile backlighting using LEDs.

BACKGROUND

Translucent media may be backlit to enhance the appearance of the media. The media may include decorative glass or plastic, photographs, paintings, or other media through which light may pass. Such translucent media may be backlit with a single light source, such as a single incandescent or a fluorescent light bulb. Backlighting the translucent media with a single light source may lead to visible non-uniformity in the brightness of the backlighting over the media. More particularly, backlighting may be visibly brighter for portions of the media closer to the single light source than for other portions of the media. In addition, backlighting with a single light source may lead to a relatively thick backlighting assembly. For example, the backlighting assembly may be several inches thick to create a cavity behind the media for the single light source and for light from the single light source to be scattered over the media.

SUMMARY

In one general aspect, a low profile backlighted display includes a translucent display piece having a viewable surface and a perimeter. A casing is configured to conform generally to the perimeter of the display piece while exposing at least a portion of the viewable surface. An illumination cavity is configured within the casing and is behind the viewable surface of the display piece. A plurality of light emitting diodes (LEDs) are located within the illumination cavity and configured to provide an essentially uniform back light illumination of the viewable surface.

In another general aspect, a low profile backlighted display includes a translucent display piece having a viewable surface. A casing for the display piece is configured to expose at least a portion of the viewable surface. An illumination cavity is configured within the casing and behind the viewable surface of the display piece. A plurality of light emitting diodes (LEDs) is located within the illumination cavity. At least one of the LEDs is configured to backlight the display piece, and at least one of the LEDs is configured to emit essentially only non-visible light. A passive element is configured to provide backlight illumination of the viewable surface when excited by non-visible light emitted by the non-visible light LEDs. The plurality of LEDs and the passive element collectively provide an essentially uniform back light illumination of the viewable surface.

Implementations may include one or more of the following features. For example, the display may form a cabinet door or a picture frame assembly. The display may have a thickness of less than about one inch.

A back surface may be configured to capture and distribute misdirected light of the plurality of LEDs to enhance the back light illumination of the viewable surface. The back surface may include a non-planar surface configured to distribute the misdirected light non-uniformly to favor a region of the viewable surface otherwise having a dimmer back light illumination. The back surface may be a reflective surface or a dispersive surface configured to scatter the misdirected light.

The illumination cavity may include an illumination perimeter that conforms generally to the perimeter of the display piece. At least some of the plurality of LEDs may be fixed relative to one or more portions of the illumination perimeter to project light away from the illumination perimeter. At least some of the plurality of LEDs is located on a back surface of the display. At least one of the plurality of LEDs may be mounted at an angle to enhance illumination uniformity.

The plurality of LEDs may be configured to provide a non-uniform pattern density that compensates for a luminous intensity that decreases with increasing distance from the plurality of LEDs.

The plurality of LEDs may include first LEDs and second LEDs. The first LEDs and the second LEDs may be positioned opposite each other, and may be configured to illuminate toward each other, within an illumination plane. A first axis of illumination of the first LEDs may be offset from a second axis of illumination of the second LEDs. A placement of the first LEDs may be staggered relative to a placement of the second LEDs causing the first axis of illumination of the first LEDs to be offset from the second axis of illumination of the second LEDs. The first and second axes of illumination may be essentially parallel to each other.

The plurality of LEDs may include at least first LEDs having a first emission angle and second LEDs having a second emission angle. The first emission angle may be about 30 degrees and the second emission angle may be about 15 degrees.

The plurality of LEDs may include at least first LEDs having a first luminous output and second LEDs having a second luminous output.

The LEDs may include LEDs that emit perceptible white light or LEDs that emit essentially only non-visible light. The LEDs that emit essentially only non-visible light comprise UV (ultraviolet) light LEDs. A passive element may be configured to provide backlight illumination of the viewable surface when excited by non-visible light emitted by the non-visible light LEDs. The passive element may be a plurality of inorganic phosphor particles, an organic phosphor pigment, or multiple color phosphor elements selected to produce a joint light emission perceptible as white light. The passive element may be placed on a back surface, on a back surface of the display piece, or within the display piece to receive non-visible light of the plurality of non-visible light LEDs and to enhance the back light illumination of the viewable surface.

These general and specific aspects may be implemented using a method, a system, or a computer program, or any combination of systems, methods, and computer programs.

Other features will be apparent from the description, the drawings, and the claims.

DESCRIPTION OF DRAWINGS

Like reference symbols in the various drawings indicate like elements.

DETAILED DESCRIPTION

Figure 1:
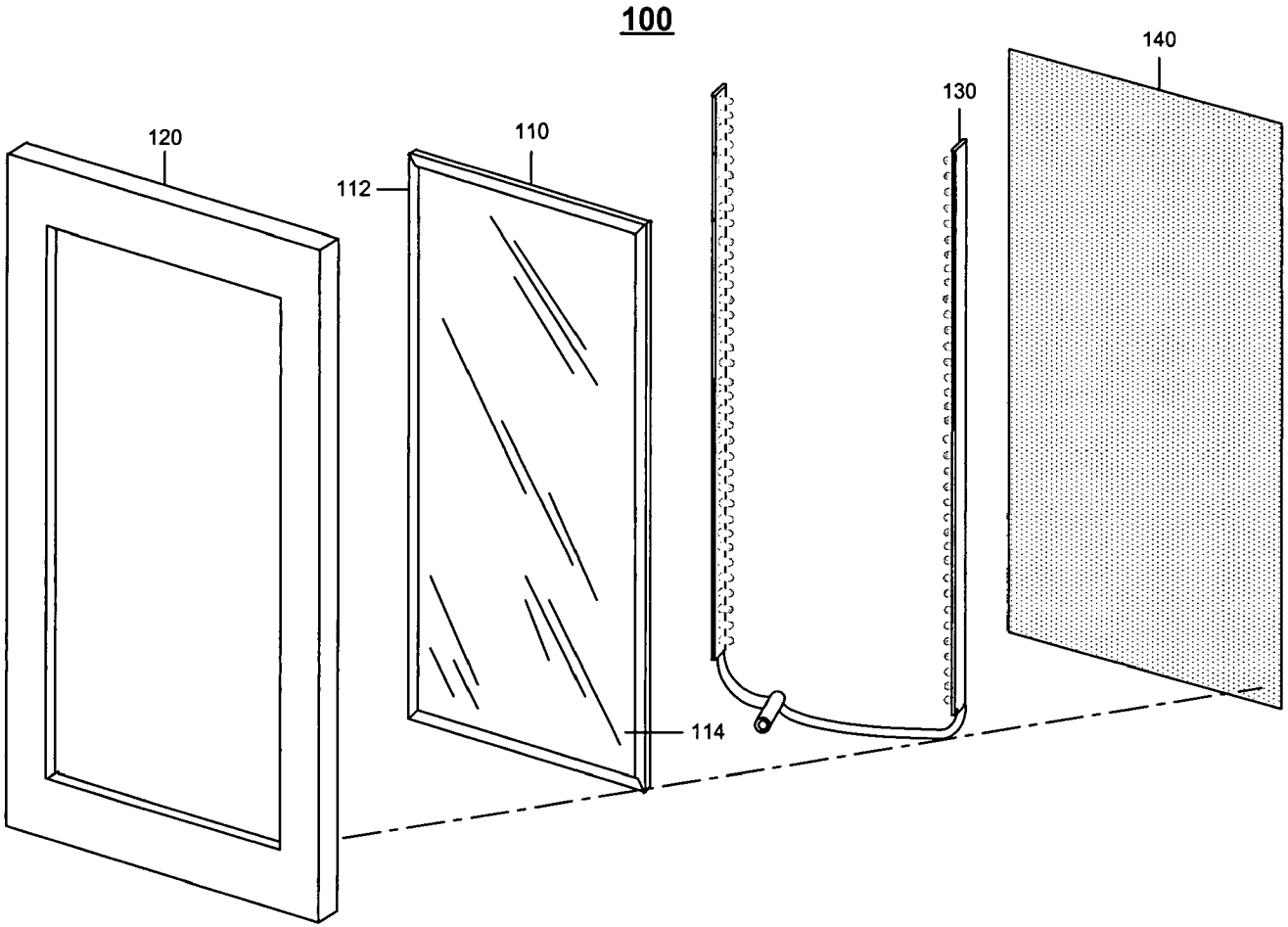
FIG. 1 is an exploded view of a low profile backlighted display.

A low profile backlighted display includes multiple light emitting diodes (LEDs) disposed around the perimeter of a translucent display piece. The LEDs are arranged around the display piece to provide essentially uniform backlighting to the display piece. For example, the LEDs may be placed at different locations relative to one another with different emission angles and intensities to provide essentially uniform backlighting to the display piece. More particularly, the LEDs are located within an illumination cavity of a casing around the display piece that exposes part of the display piece for viewing. The casing may include a planar or non-planar back surface that may reflect light from the LEDs to backlight the display piece. One or more of the LEDs may emit ultraviolet (UV) light that excites a phosphor deposition on the back surface. One or more of the LEDs may be mounted on the back surface and may directly illuminate the display piece. The LEDs for example, may employ through-side or surface mount technology, and may include a variety of packages, reflectors, and/or lenses.

Referring to FIGS. 1-6, a low profile backlighted display 100 is used to backlight a display piece 110 located within a casing 120. An LED assembly 130 mounted around a perimeter 112 of the display piece 110, includes LEDs that uniformly backlight a viewable surface 114 of the display piece 110. A back surface 140 of the display 100 reflects misdirected light from the LEDs to the viewable surface 114 of the display piece 110. The display piece 110, the casing 120, and the back surface 140 collectively form an illumination cavity 150 and an illumination perimeter 160 for the LED assembly 130.

The display piece 110 is a translucent piece through which light may pass from the LEDs included in the LED assembly 130. To illustrate, the display piece 110 may be a photograph, a document, a transparency, a piece of artwork, a piece of decorative glass or plastic, a piece of art glass, a piece of Tiffany style glass, or some other substantially flat piece through which light may pass. In implementations where the display piece 110 is not rigid, the display piece 110 may be mounted on a transparent or translucent structural piece that maintains the flat shape of the display piece 110, such as a piece of clear or colored glass or plastic. In one implementation, the display piece 110 may be mounted to the top of the structural piece such that the light from the LEDs first passes through the structural piece. In another implementation, the display piece 110 may be mounted to the bottom of the structural piece such that the light from the LEDs first passes through the display piece 110.

The casing 120 conforms generally to the perimeter 112 of the display piece 110, revealing at least part of the display piece 110, referred to herein as the viewable surface 114 of the display piece 110. For example, in implementations where the display 100 is used in a cabinet door, the edge of the cabinet door may serve as the casing 120 while the center of the cabinet door serves as the display piece 110. As another example, in implementations where the display 100 is used in a frame, the casing 120 may be the actual frame, and the display piece may be the contents of the frame. The casing 120 generally is larger than the display piece 110 in order to fit around the perimeter 112 of the display piece 110. The casing 120 may be the same or a different shape as the display piece 110. The casing 120 includes an upper lip that fits over and conforms to the perimeter 112 of the display piece 110. The upper lip 120 prevents the perimeter 112 of the display piece 110, as well as the LEDs that backlight the display piece 110, from being visible. More particularly, the LEDs are placed near the perimeter 112 of the display piece 110 underneath the upper lip of the casing 120. The display piece 110 may be attached to the casing 120 on an underside of the upper lip 120.

The LED assembly 130 is an electrical circuit that includes one or more LEDs to backlight the display piece 110. In one implementation, the LEDs have diameters of about 5 mm. The LED assembly 130 may include one or more voltage sources, such as a battery, connected in series with the LEDs, that each power one or more of the LEDs. Alternatively or additionally, the LED assembly 130 may include a plug or some other connector to connect the LED assembly 130 to an external power source. The LED assembly 130 also may include one or more resistors connected in series with the LEDs. The resistors may be used to control the current flowing to one or more of the LEDs, thus affecting the brightness of those LEDs. The resistors may have varied resistances to cause different LEDs within the LED assembly 130 to have varying brightness. The voltage sources and the resistors may be variable, thus allowing the brightness of one, some, or all of the LEDs to be controlled.

In one implementation, the LED assembly 130 conforms to the perimeter 112 of the display piece 110 such that the LED assembly fits beneath the upper lip of the casing 120. The LED assembly 130 may include LEDs on one, some, or all of the sides of the display piece. For example, in implementations where the display piece 110 is rectangular, the LED assembly 130 may include LEDs only on the long sides of the display piece 110. The LEDs of the LED assembly 130 may have varying intensities and emission angles to enhance the uniform backlighting of the display piece 110. The LEDs may emit perceptible light, such as white or colored light, or invisible light, such as ultraviolet (UV) light.

The LEDs may be placed at particular locations around the LED assembly 130 and at varying angles and orientations to uniformly backlight the display piece 110. For example, one or more of the LEDs may be angled towards the display piece 110 or towards the back surface 140 such that some light is not directed towards an opposite side of the display 100. In addition, one or more of the LEDs may be angled either to the right or left such that light from the LEDs is projected at an angle with respect to the LED assembly 130. Furthermore, the LEDs may be positioned around the LED assembly 130 such that light from one LED is not projected directly at another LED. The LEDs also may be positioned such that some of the LEDs are closer to the center of the display piece 110 than other LEDs. The LEDs that are closer to the center of the display piece 110 illuminate the center of the display piece 110, while the other LEDs illuminate the sides of the display piece 110. Placing the LEDs at varying angles and positions may enhance the uniformity of the backlighting of the display piece 110. The arrangement of the LEDs in the LED assembly 130 may depend on the geometry of the display piece 110. For example, when the display piece 110 is large, the LED assembly 130 may include narrow emission LEDs that are offset from the edge of the display piece 110 to uniformly backlight the display piece 110.

The back surface 140 attaches to a back side of the casing 120. More particularly, the casing 120, the back surface 140, and the display piece 110 collectively create the illumination cavity 150 in which the LED assembly 130 is located or into which the LED assembly 130 projects light. The display piece 110 is located at the top of the illumination cavity 150, and the LED assembly 130 is located within the illumination cavity 150 below the display piece 110. The illumination cavity 150 includes an illumination perimeter 160. The illumination perimeter 160, in turn, includes the space between the upper lip of the casing 120 and the back surface 140, and conforms generally to the perimeter 112 of the display piece 110. The LED assembly 130 is located within the illumination perimeter 160 to project light from the perimeter 112 of the display piece 110 towards the center of the display piece 110.

Figure 2:
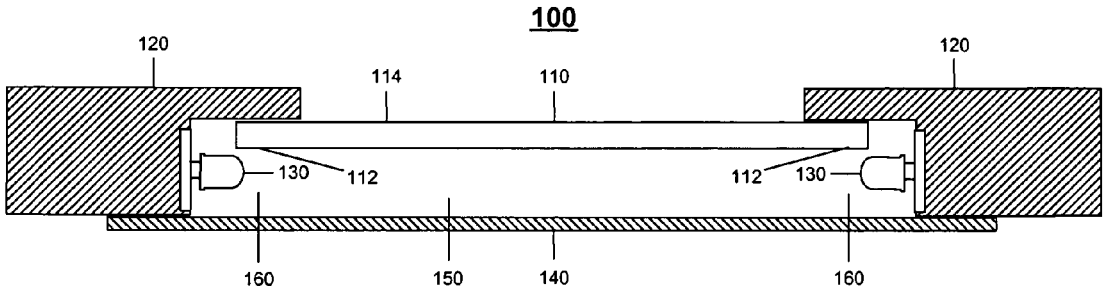
FIGS. 2-6 are cross sections of various exemplary low profile backlighted displays.

The back surface 140 captures and distributes light from the LEDs that otherwise could be misdirected away from the display piece 110. The back surface 140 may be formed of or may include one or more reflective surfaces that are used to reflect otherwise misdirected light, one or more dispersive surfaces configured to scatter otherwise misdirected light in multiple directions, or passive surfaces or components excited by light within the illumination cavity 150 and configured to generate light resulting from their excited state toward the display piece 110. The back surface 140 may be planar or non-planar. For example, the back surface 140 of FIG. 2 is flat and reflects or scatters the misdirected light uniformly.

Figure 3:
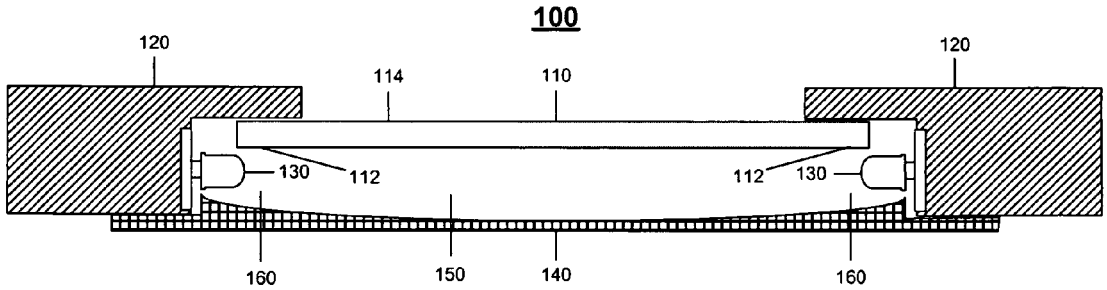
Figure 4:
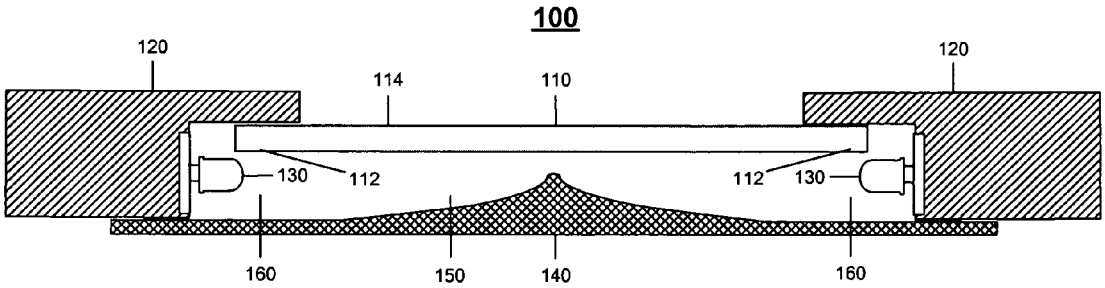
Figure 5:
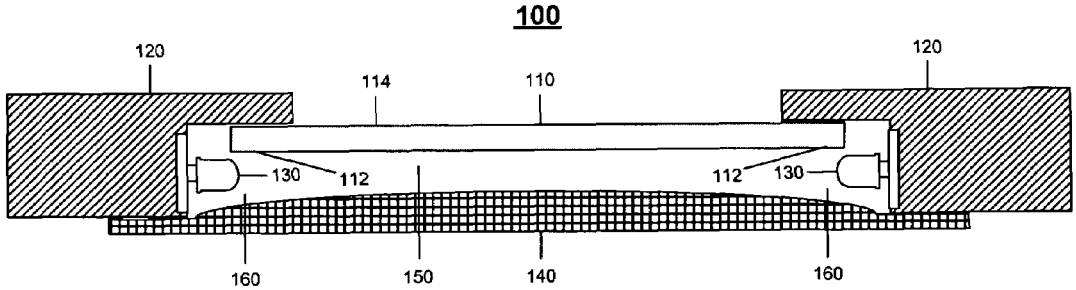

On the other hand, the back surfaces 140 of FIGS. 3-5 are non-planar and thus configured to reflect or scatter misdirected light from the LED non-uniformly to favor portions of the display piece 110 that otherwise receive less direct light from the LEDs than other portions of the display piece 110. For example, the center of the display piece 110 typically is not backlit as brightly as the sides of the display piece because the intensity of light from the LEDs dissipates as the light travels from the LEDs. The non-planar back surfaces 140 of FIGS. 3-5 reflect or scatter the misdirected light to the center of the display piece 110 to backlight the center of the display piece 110 more brightly. For example, the concave curvature of the back surface 140 of FIG. 3 causes light that encounters the back surface 140 to be reflected or scattered towards the center of the display piece 110.

The back surfaces 140 of FIGS. 4 and 5 are contoured to decrease the distance traveled by light reflected or scattered to the center of the display piece 110, which decreases the dissipation of the intensity of the light. Therefore, light reflected or scattered from the back surfaces 140 to the center of the display piece 110 is brighter than light reflected or scattered from the back surfaces 140 to other portions of the display piece 110; this compensates for direct light from the LEDs backlighting the other portions of the display piece 110 more brightly than the center of the display piece 110.

Figure 6:
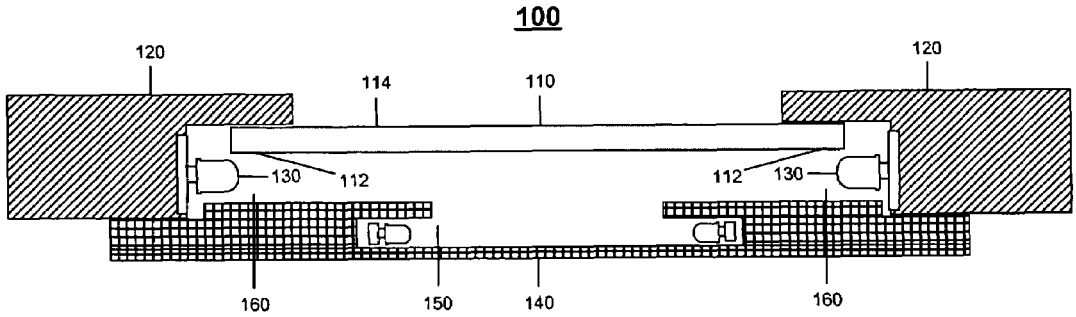

The back surface 140 of FIG. 6 is a non-planar back surface that includes multiple planar sections. More particularly, the back surface 140 includes a central planar piece that is offset from one or more peripheral planar pieces. As a result, the distance from the central planar piece to the display piece 110 is greater than the distance from the peripheral planar pieces to the display piece 110. In addition, the central planar piece may overlap with the peripheral planar pieces, which creates a space between the central planar piece and the peripheral planar pieces that is not visible through the display piece 110. One or more LEDs may be placed in the space between the central planar piece and the peripheral planar pieces to provide light to the center of the display piece 110. The light from those LEDs and the light from the LEDs included in the LED assembly 130 collectively backlight the display piece 110 in a uniform manner.

The display 100 may be used in cabinet doors, such as doors to cabinets in a kitchen, a bathroom, or a hutch. The display 100 also may be used in frame assemblies for photographs, documents, artwork, or other substantially flat display media. In addition, the display 100 may be used in wall mounted applications, such as the walls of a bathroom shower or tub area, a kitchen back splash area, or any other wall or ceiling in a home or office providing a confined space. Typical implementations of the display 100 are rectangular or are shaped like a regular polygon, such as a regular octagon.

In one implementation, the display 100 is about two feet in length and one foot in width. The display 100 typically has a thickness of approximately one inch. For example, the display 100 has a thickness of 0.75 inches in one implementation. As such, the low profile backlighted display 100 is not substantially thicker than similar displays that do not include backlighting components. The display 100 consequently may be used in lieu of displays that lack backlighting without substantial modification to the display location. For example, the backlighted display 100 likely would be mounted in a similar size space and in a similar manner as a non-backlighted display. Furthermore, backlighting components of the display 100 may be used to retrofit, and thus supplement, displays lacking backlighting, or those with alternative backlighting schemes.

In some implementations, components of the display 100 may be combined. For example, the casing 120 and the back surface 140 may be combined into a single encasement for the display piece 110. Alternatively or additionally, a separate encasement for the display 100 or the display piece 110 may include or replace one or more of the components of the display 100. For example, an encasement of the display 100 or the display piece 110 may include or replace the back surface 140. For ease of description, the components of the display 100 are described as being part of the display 100, instead of as being part of a separate encasement for the display 100 or the display piece 110.

Figure 7:
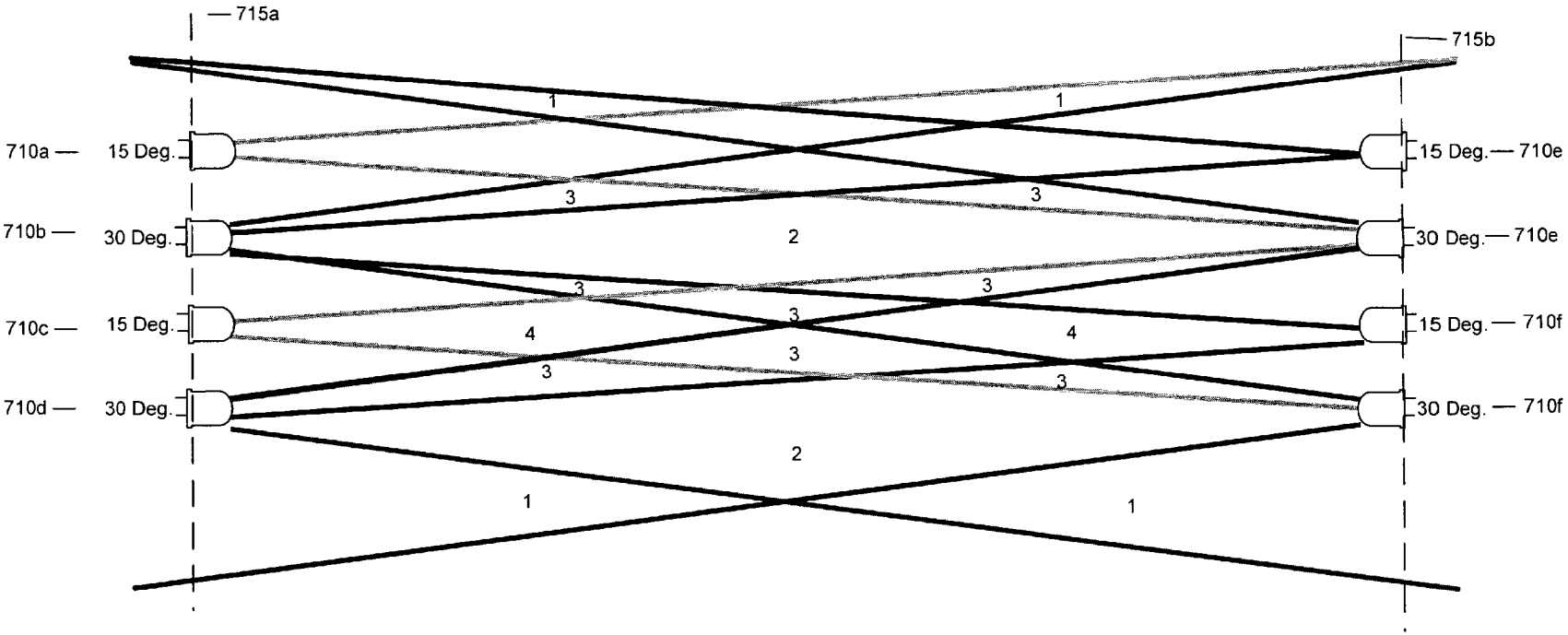
FIG. 7 is an illustration of an arrangement of LEDs in a low profile backlighted display.

Referring to FIG. 7, one implementation of the LED assembly 130 of FIGS. 1-6 includes LEDs 710*a*-710*h* on two long sides of a rectangle configured to transmit light toward each other through the space between the two long sides. The LEDs 710*a*-710*h* are arranged to create uniform backlighting between the two long sides, for example, to backlight a display piece, such as the display piece 110 of FIGS. 1-6. LEDs on only two sides of the rectangle may be sufficient to uniformly backlight the display piece.

The LEDs 710*a*-710*d* may be said to be on a first axis 715*a* of LEDs, and the LEDs 710*e*-710*h* may be said to be on a second axis 715*b* of LEDs. In typical implementations, the first axis 715*a* is essentially parallel to the second axis 715*b*. Moreover, although they lie in the same plane, the LEDs 710*a*-710*d* are offset from the LEDs 710*e*-710*h*. Consequently, none of the LEDs 710*a*-710*d* is aimed directly at any of the LEDs 710*e*-710*h*, and vice versa. In other words, the placement of the LEDs 710*a*-710*d* is staggered relative to the placement of the LEDs 710*e*-710*h*, and the first axis 715*a* of LEDs is offset from the second axis 715*b* of LEDs. In the illustrated implementation, the first axis 715*a* is offset from the second axis 715*b* by 0.25 inches. In other implementations of the LED assembly 130, the first axis 715*a* and the second axis 715*b* of LEDs may be aligned without any stagger or offset.

In the illustrated implementation, an even space of 0.5 inches exists between the LEDs 710*a*-710*d* and between the LEDs 710*e*-710*h*. In other implementations, the LEDs 710*a*-710*d* and the LEDs 710*e*-710*h* may be non-uniformly distributed along the first axis 715*a* and the second axis 715*b*, respectively. In the illustrated implementation, the LEDs 710*a*-710*h* have an emission angle of 15 degrees. In other implementations, the LEDs 710*a*-710*h* may have different, potentially non-uniform, emission angles. As a result of the offset between the first and second axes, non-uniform LED spacing, non-uniform emission angles, or non-uniform intensities, the LEDs 710*a*-710*h* may have a non-uniform pattern density that compensates for the decreasing intensity of the LEDs 710*a*-710*h* relative to increasing distance.

Light from multiple LEDs combines in the space between the LEDs 710*a*-710*h*. Because the intensity of the light dissipates with distance traveled, the display is configured such that light from a larger number of the LEDs 710*a*-710*h* combines at the center of the space to produce a brightness of light similar to what is produced by one or a small number of LEDs at the edges of the space. Light produced by one of the LEDs 710*a*-710*h* is represented as the space between a pair of lines emanating at the LED. More particularly, the space between a pair of lines for an LED represents the space over which light from an LED is transmitted, though the intensity of the light may vary over the space. The angle between the lines for one of the LEDs 710*a*-710*h* is the emission angle of the LED.

The spaces representing the light projected by the LEDs 710*a*-710*h* overlap, and each of the numbers in the space between the LEDs 710*a*-710*h* identifies the number of LEDs whose light is transmitted to the numbered location. To achieve uniform light distribution, the numbers in the central spaces between the LEDs 710*a*-710*h* generally should be larger than the numbers on the side spaces.

Notably, even though some of the numbers on the sides of the space are larger than the numbers in the center of the space, uniform light distribution may be achieved. For example, some of the points on the sides of the space are labeled with a "3" to indicate that light from three LEDs reaches that point. However, two of those LEDs are located on the opposite side of the space and, the intensity of the light from those two LEDs dissipates over the relatively large distance traveled and may not contribute significant brightness at that point. As such, light from only one LED effectively reaches each side point.

Furthermore, others of the points on the sides of the space are labeled with a "1" to indicate that light from one LED reaches each of those points. In fact, the one LED that provides light to one of the points labeled with a "1" is located on an opposite side of the space as the point, which may result in those points being darker than other points. However, the LEDs 710*a*-710*h* may be so close together that a difference in brightness may not be perceivable. In addition, the light from LEDs near the points labeled with a "1" may reach those points, because light from those LEDs may reach points outside of the lines emanating from those LEDs. Light from a back surface also may supplement the light from the LEDs 710*a*-710*h* that reaches the points labeled with a "1." As a result, a comparable amount of light reaches the points labeled "3" and the spaces labeled "1" such that relatively uniform light distribution is achieved.

On the other hand, light from two LEDs reaches each point in the central spaces. In addition, the intensity of the light from the two LEDs illuminating a central space is significantly strong and both LEDs contribute to the brightness of the light at the central space. Stated differently, the contributions of the LEDs 710*a*-710*h* counted within the center of the space are generally greater than the contributions of LEDs counted among the sides of the space, such that uniform light distribution is achieved. To enhance the uniform light distribution, the LEDs 710*a*-710*h* may be placed at varying positions relative to the center of the space or to the LEDs on the opposite sides of the space and at varying angles and orientations and may have varying intensities and emission angles, as described earlier.

In some implementations, the edges of the display piece may be covered by the casing of the display piece. As a result, portions of the display piece that are backlighted more or less brightly than other portions of the display piece may be covered such that only portions of the display piece that are uniformly backlit are visible. For example, the portions of the display piece corresponding to the points labeled with a "1" may be covered by the casing if those points are not as brightly backlit as other portions of the display piece.

Figure 8A:
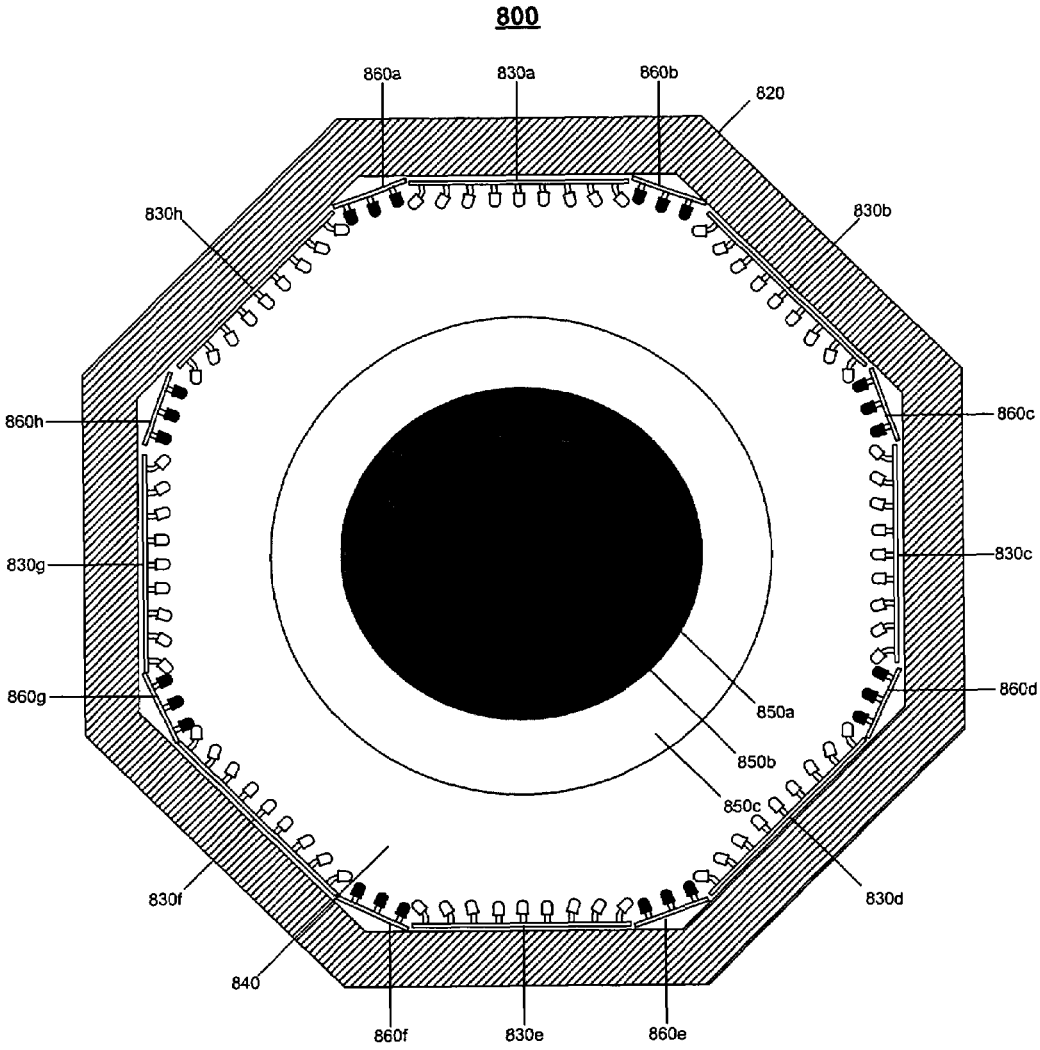
FIGS. 8A-8E are illustrations of a low profile backlighted display having phosphor depositions illuminated by ultraviolet LEDs.

Referring to FIG. 8A, a low profile backlighted display 800 that is similar to the display 100 of FIGS. 1-6 is shaped as a regular octagon. The display 800 is illustrated without an associated display piece, which also is octagonal and which is similar to the display piece 110 of FIGS. 1-6. The display 800 includes a casing 820 that is similar to the casing 120 of FIGS. 1-6, LED assemblies 830*a*-830*h* that are each similar to the LED assembly 130 of FIGS. 1-6, and a back surface 840 that is similar to the back surface 140 of FIGS. 1-6. The back surface 840 includes phosphor depositions 850*a*-850*c* that are illuminated by the UV LEDs assemblies 860*a*-860*h*.

The LED assemblies 830*a*-830*h* may be connected in parallel with one another to a common voltage source that powers associated LEDs. Alternatively or additionally, each of the LED assemblies 830*a*-830*h* may have a dedicated voltage source. Similarly, the brightness of the LEDs associated with the LED assemblies 830*a*-830*h* may be controlled with common or dedicated resistors, which may have varied resistances in some implementations. The voltage sources and the resistors of the LED assemblies 830*a*-830*h* may be variable to enable control of the brightness of the corresponding LEDs. For example, the LEDs in the centers of the LED assemblies may be made brighter than the LEDs at the ends of the LED assemblies 830*a*-830*h* by causing more current to flow to the central LEDs. Such a configuration may be advantageous because the orientations of the LED assemblies 830*a*-830*h* result in a higher concentration of LEDs at the ends of the LED assemblies 830*a*-830*h* than in the center of the LED assemblies 830*a*-830*h*. Making the central LEDs brighter than other LEDs compensates for such a difference in LED concentration.

The LEDs are at varying angles relative to main axes of the corresponding LED assemblies 830*a*-830*h*. Consequently, some LEDs direct light towards the center of the back surface 840, while others direct light towards portions of the back surface 840 that would not receive light if the LEDs were not placed at varying angles. For example, the LEDs in the center of the LED assemblies 830*a*-830*h* direct light perpendicularly away from the main axes of the LED assemblies 830*a*-830*h* and towards the center of the back surface 840. However, the LEDs on the sides of the LED assemblies 830*a*-830*h* are placed at angles relative to the main axes such that light is not directed toward the center of the back surface 840. Instead, the LEDs on the sides of the LED assemblies 830*a*-830*h* direct light towards portions of the back surface 840 that otherwise would not receive light. The LEDs are placed at an angle to uniformly backlight the display piece of the display 800.

The back surface 840 may be a planar or non-planar reflective or dispersive surface that captures and distributes misdirected light from the LED assemblies 830*a*-830*h* to the display piece. The center of the back surface 840 includes phosphorous depositions 850*a*-850*c* that are excited by UV light. The depositions 850*a*-850*c* backlight the center of the display piece when excited to compensate for the LED assemblies 830*a*-830*h* being unable to adequately backlight the center of the display piece such that the display piece is backlit uniformly. The depositions 850*a*-850*c* differ in density or thickness. More particularly, the deposition 850*a* is the densest deposition, followed by the deposition 850*b* and the deposition 850*c*. In general, a higher density deposition provides a brighter illumination when excited by a particular amount of UV light. Providing denser depositions at the center of the back surface 840*a* compensates for the fact that less light may be available at the center of the back surface 840. As a result, the brightness of the illumination produced by the excited depositions 850*a*-850*c* is essentially uniform, which results in essentially uniform backlighting of the display piece when used in addition to the LED assemblies 830*a*-830*h*. In other implementations, a phosphorous deposition may be placed at the center of the back surface 840 whose density gradually decreases towards the perimeter of the back surface 840, instead of in discrete steps as is done for the depositions 850*a*-850*c*.

In one implementation, the depositions 850*a*-850*c* include a plurality of inorganic phosphor particles. The size of particles of the depositions 850*a*-850*c* affects the apparent uniformity of the illumination of the excited depositions 850*a*-850*c*. More particularly, smaller particles in the excited depositions 850*a*-850*c* result in a more uniform illumination. In another implementation, the depositions 850*a*-850*c* may include an organic phosphor pigment. In another implementation, the depositions 850*a*-850*c* may include multiple color phosphor elements selected to produce a joint light emission that is perceptible as white light.

In some implementations of the display 800, the phosphor depositions 850*a*-850*c* may be placed on a back surface of the display piece instead of on the back surface 840. More particularly, the phosphor depositions 850*a*-850*c*, whether organic or inorganic, may be placed on an underside of the display piece within an illumination cavity of the display 800 such that the depositions 850*a*-850*c* are not easily seen when viewing the display 800. In another implementation, the phosphor depositions 850*a*-850*c* may be placed within, or are otherwise integrated into, the display piece.

The UV LED assemblies 860*a*-860*h* include UV LEDs that produce UV light that excites the depositions 850*a*-850*c*. The UV LEDs transmit UV light directly at the depositions 850*a*-850*c*. Light from the LED assemblies 830*a*-830*h* also may illuminate the depositions 850*a*-850*c*. The UV LED assemblies 860*a*-860*h* are similar to the LED assemblies 830*a*-830*h*. The UV LED assemblies 860*a*-860*h* may be connected in parallel with and be powered by the same voltage source as the LED assemblies 830*a*-830*h*. Alternatively or additionally, each of the UV LED assemblies 860*a*-860*h* may be powered by one or more dedicated voltage sources. Similarly, the brightness of the UV LEDs may be controlled with common or dedicated resistors, which may have varied resistances in some implementations. The voltage source and the resistors of the UV LED assemblies 860*a*-860*h* may be variable to enable control of the brightness of the UV LEDs.

Figure 8B:
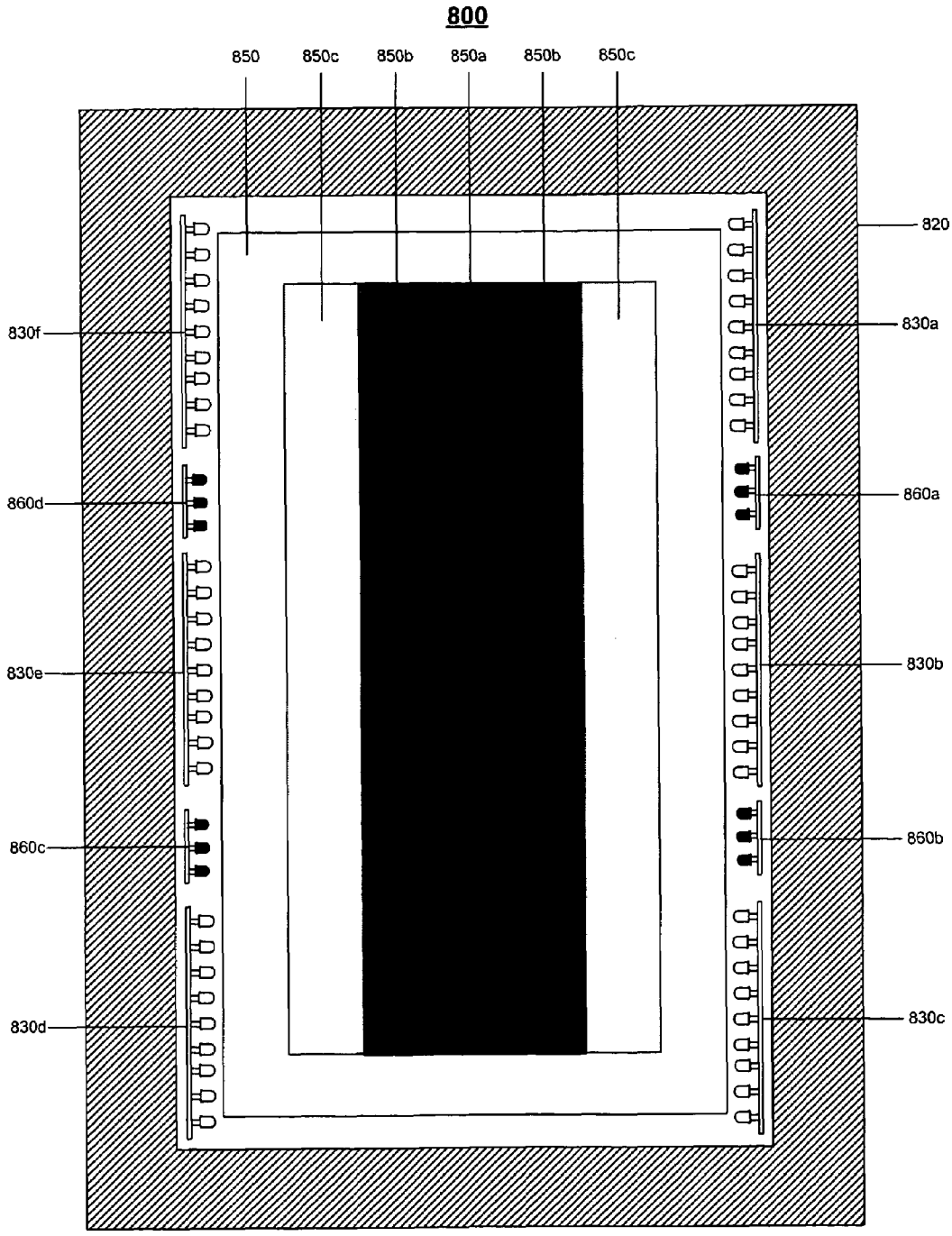

Phosphor depositions also may be used in a rectangular low profile backlighted display, such as the display 800 of FIG. 8B, in which LEDs of an LED assembly are placed on two opposite sides of the display. In such a display, the phosphor depositions 850*a*-850*c* are placed in bands in the center of a back surface or a display piece of the display. In one implementation, the bands extend between ends of the back surface or the display piece at which no LEDs are found. The phosphor depositions 850*a*-850*c* may have varying densities, with the density of the depositions 850*a*-850*c* decreasing with increased distance from the center of the back surface 840 or the display 800. In such a display, LED assemblies 860*a*-860*d* that include LEDs emitting non-visible light, such as, for example, TV LEDs, may be included among LED assemblies 830*a*-830*h* to illuminate the phosphor depositions 850*a*-850*c*. More particularly, the UV LEDs are added to sides of the LED assembly that are parallel to the bands of phosphor deposition.

Figure 8C:
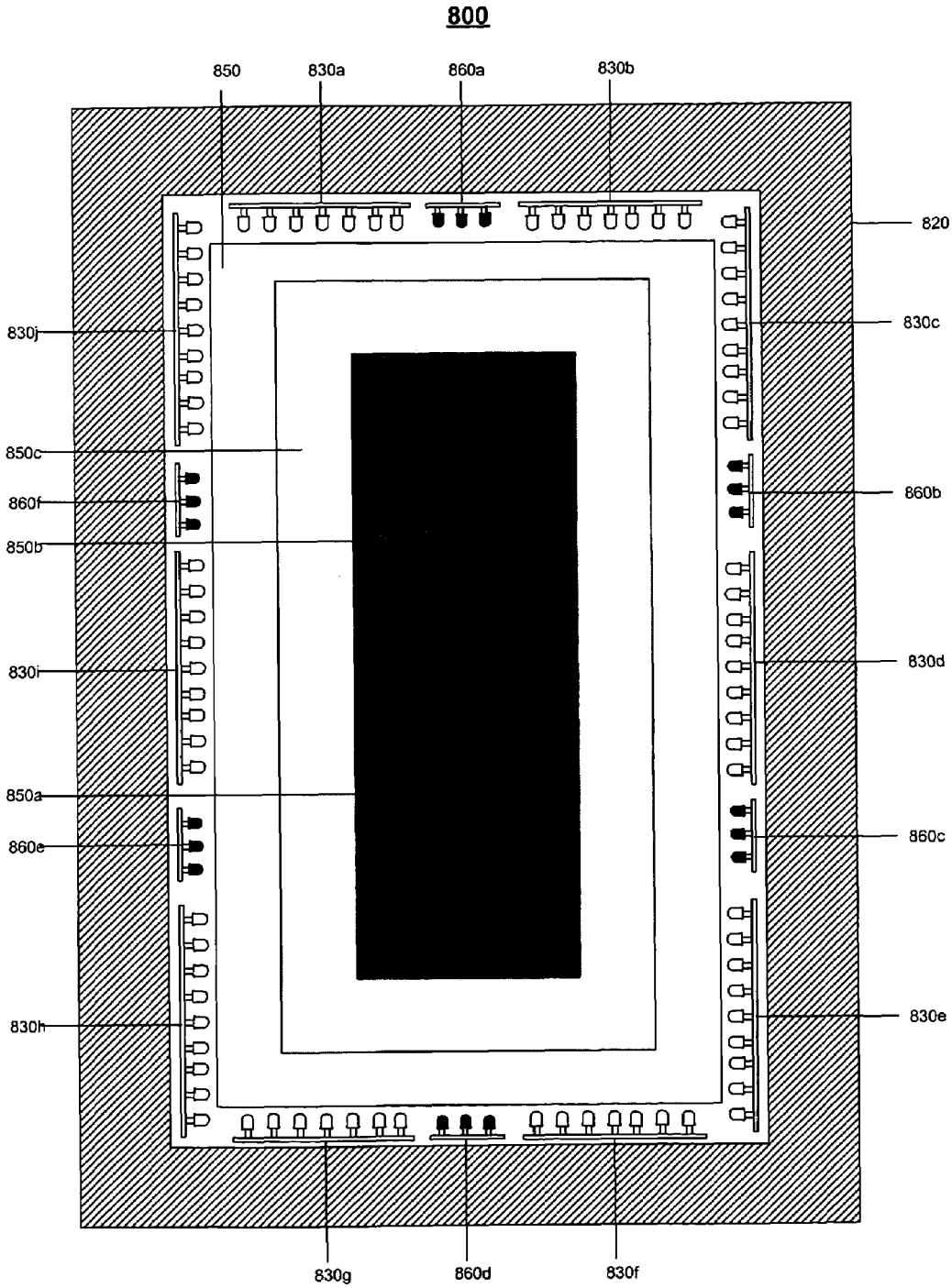
Figure 8D:
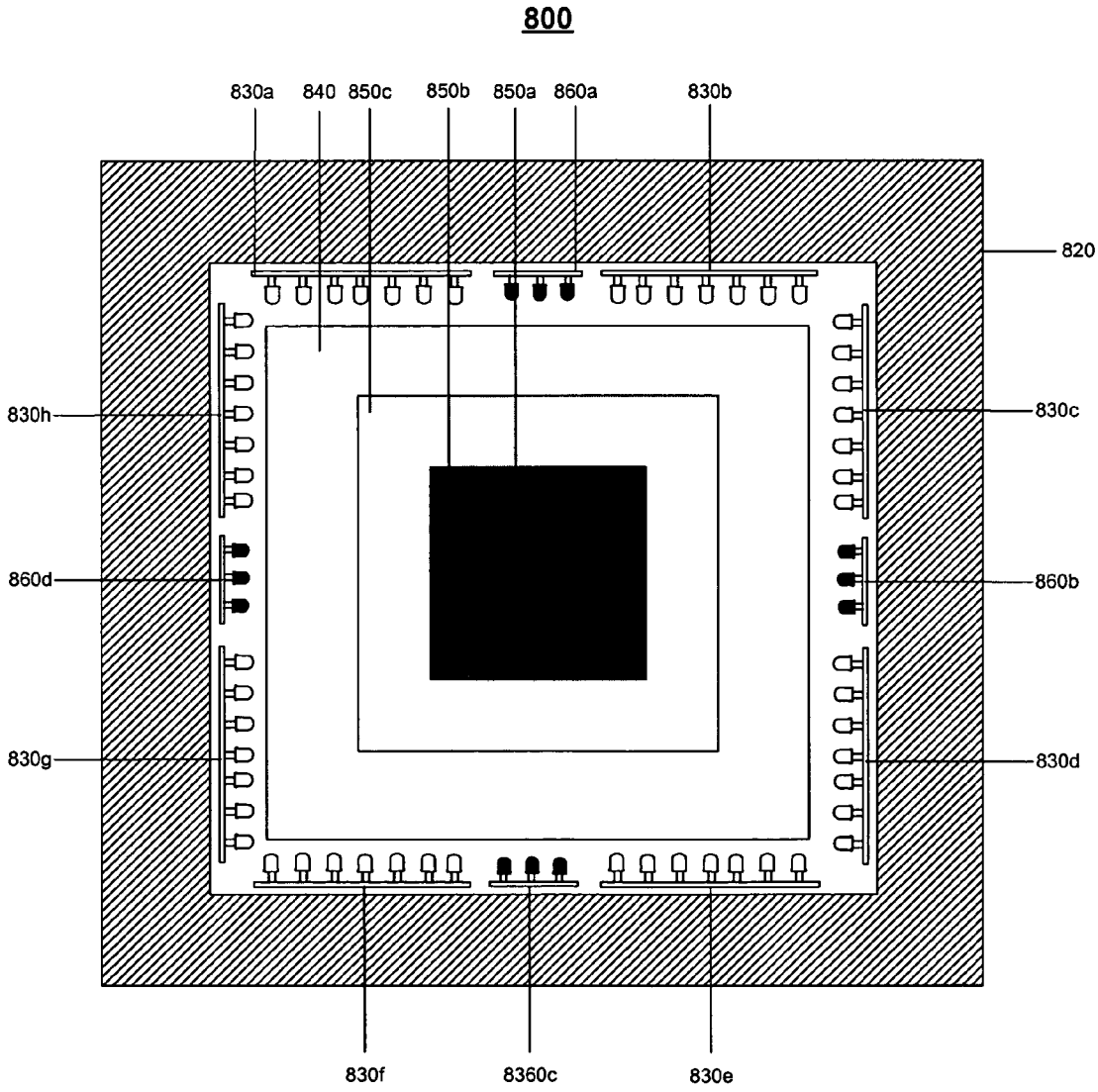
Figure 8E:
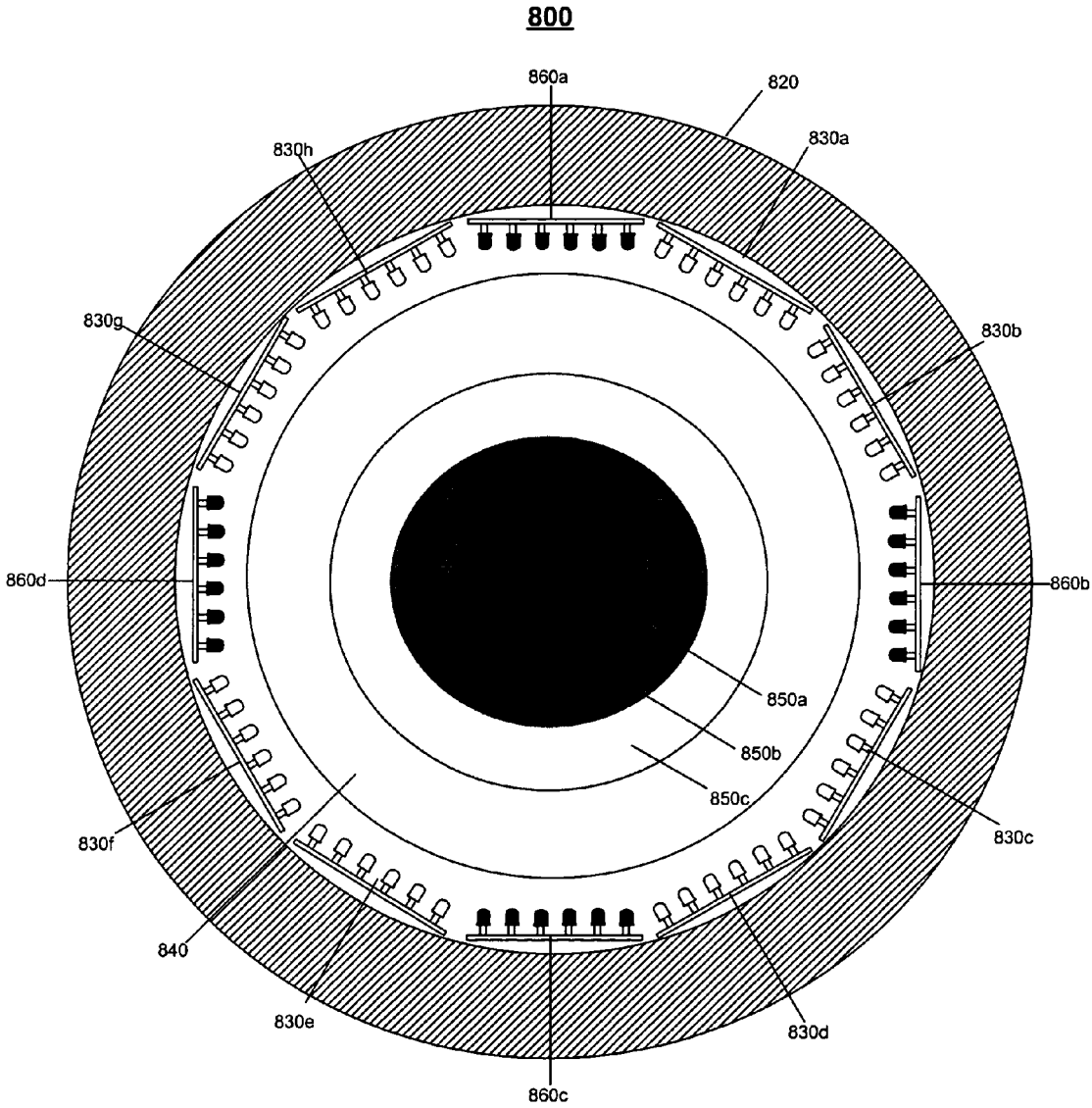

Other implementations of the low profile backlighted display 800 may have shapes that are different than the regular octagon illustrated in FIG. 8A and the rectangle illustrated in FIG. 8B. Furthermore, the other implementations may include LED assemblies on all sides of the display 800. For example, the low profiled backlighted display 800 of FIG. 8C is shaped as a rectangle, the low profile backlighted display of FIG. 8D is shaped as a square, and the low profile backlighted display 800 of FIG. 8E is shaped as a circle. The low profile back lighted display 800 may have other shapes in other implementations. Regardless of the overall shape, each implementation of the low-profile backlighted display 800 includes an associated display piece, a casing 820, at least one LED assembly 830*a*-830*j*, and a back surface 840. The back surface 840 may include phosphor depositions 850*a*-850*c* and UV LED assemblies 860*a*-860*f*. In such implementations, the phosphor depositions 850*a*-850*c* may have varying densities, and a first phosphor deposition that is illustrated darker than a second phosphor deposition in FIGS. 8A-8E has a higher density than the second phosphor deposition.

Figure 9:
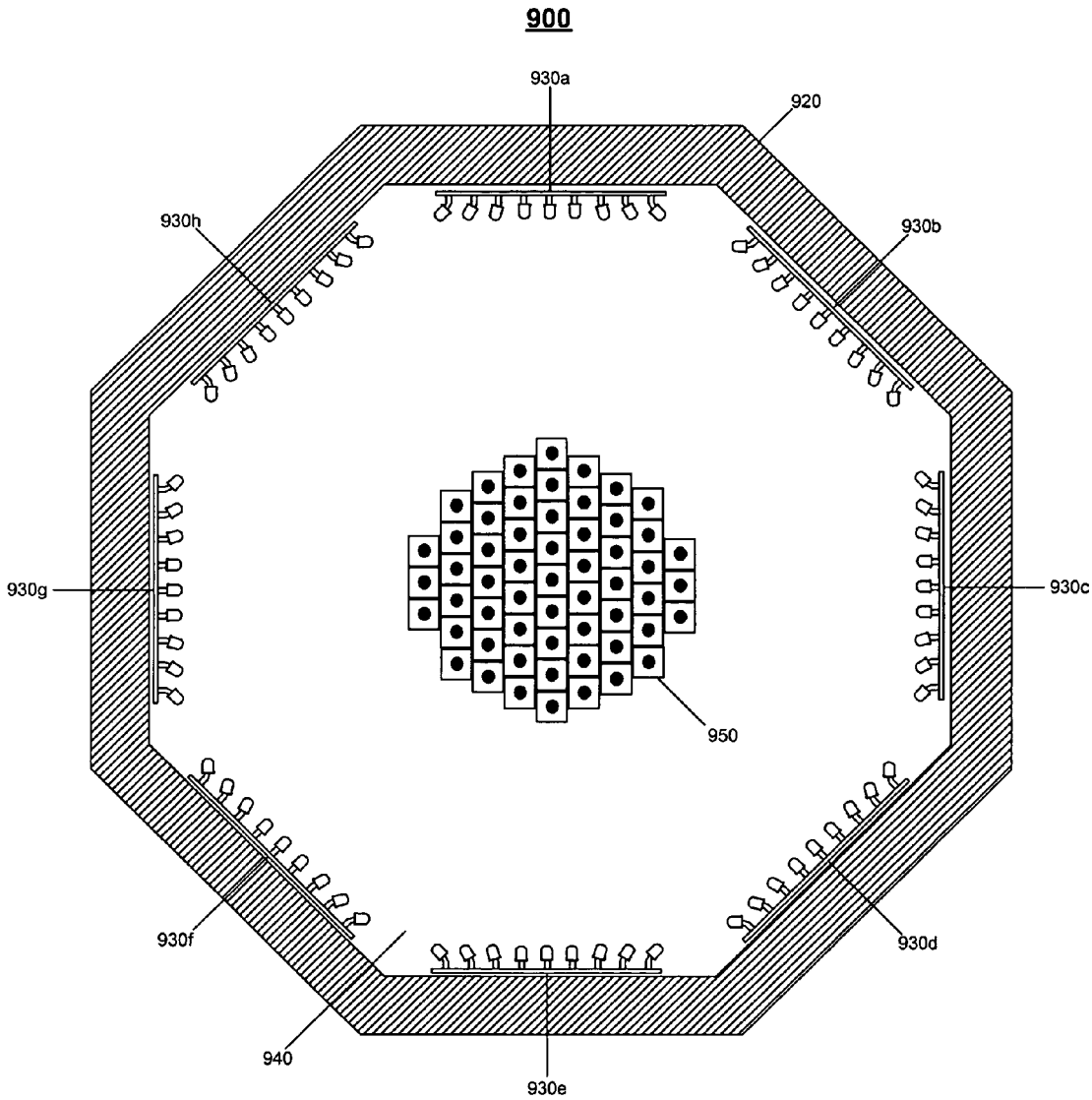
FIG. 9 in an illustration of a low profile backlighted display that includes ultra low profile LEDs mounted on a back surface of the display.

Referring to FIG. 9, a low profile backlighted display 900 that is similar to the display 800 of FIGS. 8A-8E includes a casing 920 that is similar to the casing 820 of FIGS. 8A-8E, LED assemblies 930*a*-930*h* that are similar to the LED assemblies 830*a*-830*h* of FIGS. 8A-8E, and a back surface 940 that is similar to the back surface 140 of FIGS. 1-6. The back surface 840 includes an ultra low profile LED assembly 950.

The ultra low profile LED assembly 950 may include one or more ultra-low profile LEDs that are mounted on the back surface 840. The ultra low profile LEDs may be needed to backlight the center of a display piece of the display 900 because the LED assemblies 930*a*-930*h* may be unable to adequately backlight the center of the display piece such that the display piece is backlit uniformly. Diffuser lenses may be placed over the ultra low profile LEDs to scatter the light from the ultra low profile LEDs such that the display piece may be backlit uniformly. The ultra low profile LED assembly 950 is similar to the LED assemblies 130, 830*a*-830*h*, and 930*a*-930*h*. The ultra low profile LED assembly 950 may be connected in parallel with one or more of the LED assemblies 930*a*-930*h* to a common voltage source that powers associated LEDs. Alternatively or additionally, the ultra low profile LED assembly 950 may have a dedicated voltage source. Similarly, the brightness of the LEDs associated with the ultra low profile LED assembly 950 may be controlled with common or dedicated resistors, which may have varied resistances in some implementations. The voltage source and the resistor of the ultra low profile LED assembly 950 may be variable to enable control of the brightness of the corresponding LEDs.

Figure 10:
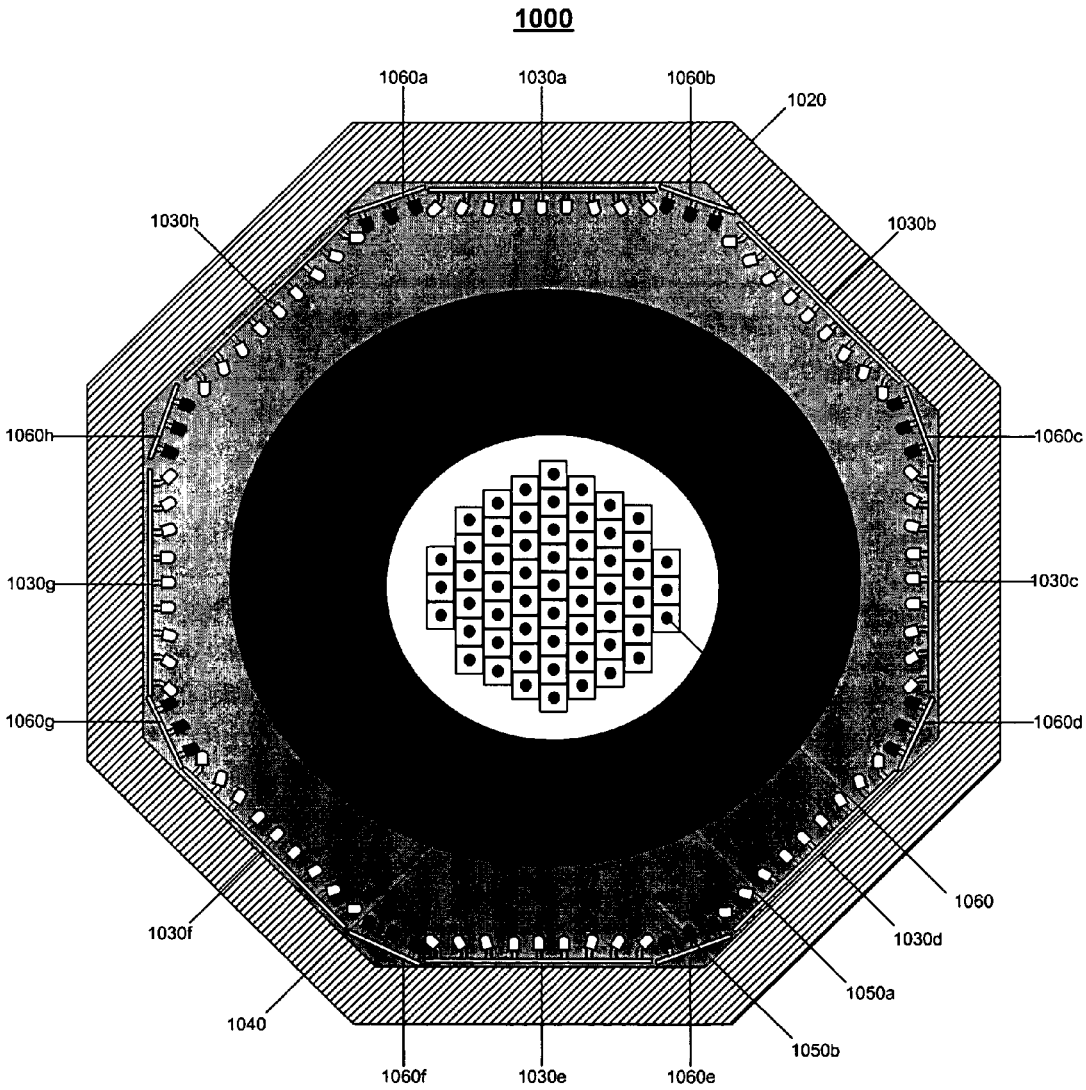
FIG. 10 is an illustration of a low profile backlighted display that includes phosphor depositions and ultra low profile LEDs.

Referring to FIG. 10, various components of the low profile backlighted displays described above may be combined into a low profile backlighted display 1000. The low profile backlighted display 1000 is similar to the low profile backlighted displays described with respect to FIGS. 1-9, except the display 1000 includes LED assemblies 1030*a*-1030*h*, phosphor depositions 1050*a* and 1050*b*, and low profile LED's 1060. As a result, the LED assemblies 1030*a*-1030*h* illuminate the edges of a display piece of the display 1000, the low profile LEDs 1060 illuminate the center of the display piece, and the phosphor depositions 1050*a* and 1050*b* illuminate the remainder of the display piece. The phosphor depositions may be excited by the LED assemblies 1030*a*-1030*h* and the low profile LEDs 1060 which may include one or more UV LEDs. Because the center of the display piece is illuminated by the low profile LEDs 1060, a phosphor deposition is not required in the center of the back surface 1040. Instead, phosphor depositions are only required between the LED assemblies 1030*a* and 1030*h* and the low profile LEDs 1060. The phosphor depositions 1050*a* and 1050*b* may have different densities to compensate for different amounts light available to excite the phosphor depositions. In some implementations of the display 1000, the LED assemblies 1030*a*-1030*h* may not be necessary to uniformly backlight the display piece. Furthermore, the low profile LEDs 1060 may include only a single LED that backlights the display piece and excites the phosphor depositions 1050*a* and 1050*b*.

Figure 11:
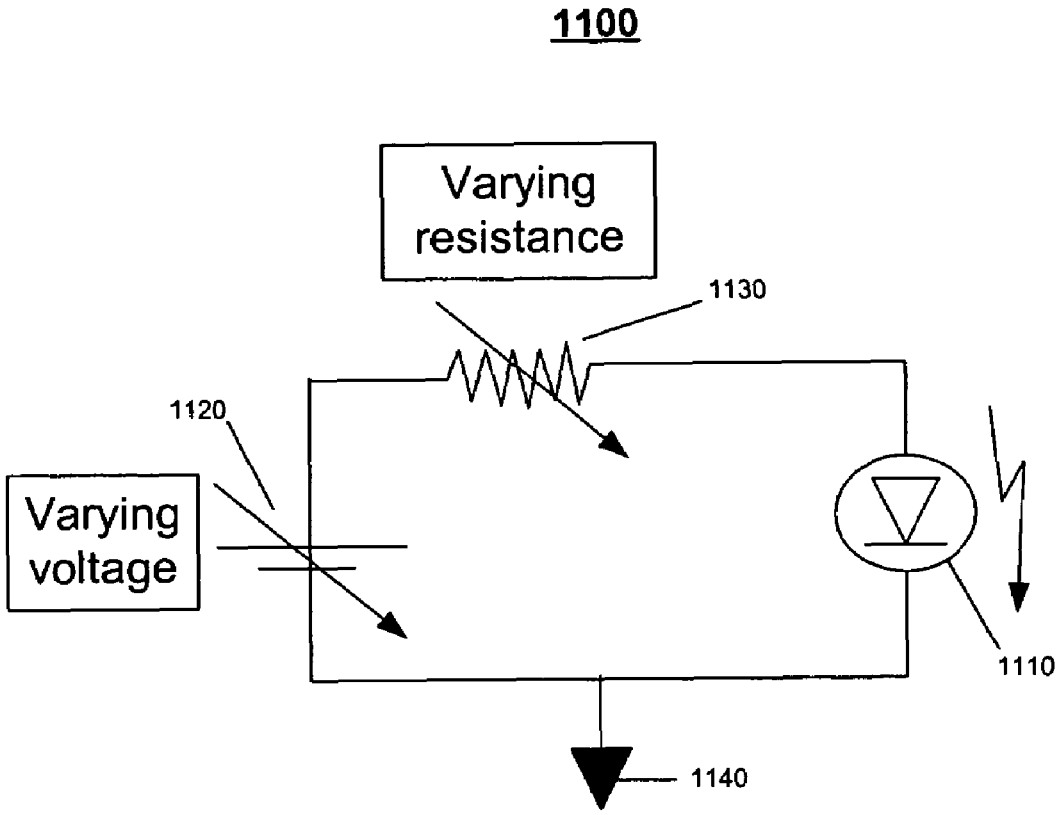
FIG. 11 is an illustration of an electronic circuit for controlling luminous intensity of LEDs included in a low profile backlighted display.

Referring to FIG. 11, an electrical circuit 1100 is used to power and to control the brightness or intensity of one or more LEDs. The circuit 1100 includes at least one LED 1110, a voltage source 1120, and a resistor 1130 that are connected in series with one another to ground 1140.

The circuit 1100 is used to vary the forward current flowing to the one or more LEDs, which varies the intensity of the one or more LEDs. In general, the intensity of an LED is directly related to the forward current flowing to the LED. LED assemblies, such as the LED assemblies 130 of FIGS. 1-6, 830*a*-830*h* and 860*a*-860*h* of FIGS. 8A-8E, and 930*a*-930*h* and 950 of FIG. 9, may include one or more instances of the circuit 1100 to power and to control associated LEDs. In one implementation, an LED assembly includes one instance of the circuit 1100 to control three associated LEDs. The LEDs may be controlled within the LED assemblies with the instances of the circuit 1100 such that the LEDs uniformly backlight a display piece.

The LED 1110 represents one or more LEDs from an LED assembly that includes the circuit 1100. The one or more LEDs may include several LEDs that are located near one another, all LEDs on a particular side of the LED assembly, or all LEDs in the LED assembly.

The voltage source 1120 represents a source of power for the one or more LEDs. More particularly, the voltage source 1120 may represent a battery, a plug or some other connector to a source of power for the one or more LEDs. In one implementation, the voltage produced by the source of power may be varied to vary the forward current flowing to the one or more LEDs.

The resistor 1130 represents one or more resistors with an effective resistance that controls the forward current flowing to the one or more LEDs. In one implementation, the effective resistance represented by the resistor 1130 may be varied to vary the forward current flowing to the one or more LEDs.

The voltage source 1120 and the resistor 1130 collectively identify a forward current flowing through the LED 1110. Therefore, the voltage source 1120 and the resistor 1130 collectively identify a brightness or an intensity of the one or more LEDs. The voltage produced by the voltage source 1120 and the effective resistance represented by the resistor 1130 may be set or manipulated to produce a desired brightness or intensity in the one or more LEDs such that the one or more LEDs uniformly backlight a display piece, perhaps with other LEDs.

The circuit 1100 also may include a photodiode connected in series with the LED 1110, the voltage source 1120, and the resistor 1130. The photodiode may automatically control the current flowing to the LED 1110 based on an amount of detected ambient light. For example, the photodiode may vary the current directly or indirectly with the amount of detected ambient light. In such a case, the brightness of the LED 1110 depends directly or indirectly on the amount of ambient light. Similarly, other sensors may be added to the circuit 1100 to automatically vary the current flowing to the LED 1110. The sensors may themselves control the current flowing to the LED 1110, or the sensors may vary the voltage produced by the voltage source 1120 or the effective resistance of the resistor 1130 to control the current flowing to the LED 1110.

The implementations of the low profile backlighted display illustrated in FIGS. 8A-8E and 10, include one or more phosphor depositions that, when excited by light from one or more UV LEDs, supplement backlighting provided by other LEDs included in the display. However, all implementations of the low profile backlighted display need not include phosphor depositions and corresponding UV LEDs, for example, when the other LEDs independently provide uniform backlighting. As a result, implementations of the low profile backlighted display may have any shape, such as a rectangle, a square, a circle, a regular octagon, or another polygon, without including one or more phosphor depositions and one or more corresponding UV LEDs.

Phosphor depositions are used throughout as an example of a passive element that illuminates a portion of a display piece of a low profile backlighted display. However, other passive elements may be used to illuminate the display piece. For example, other luminescent elements may be applied to a back surface of the low profile backlighted display, or to the display piece itself, to illuminate the display piece.

The arrangements, numbers, positions, and relative locations of LEDs and UV LEDs illustrated throughout are examples that may result in uniform backlighting of a display piece of a low profile backlighted display. Different arrangements, numbers, positions and relative locations may be required in different low profile backlighted displays to uniformly backlight a corresponding display piece. The arrangements, numbers, positions, and relative locations may depend on the form factor of the display and the display piece, or on the luminous properties of the display piece.

Furthermore, additional lighting components, such as a planar or contoured back surface and a passive element, may be used to supplement backlighting provided by LEDs in some implementations of a low profile backlighted display. For example, in implementations where the LEDs are located around the perimeter of the display, additional lighting components may be needed to supplement backlighting in the center of the display. The need for the additional lighting components may depend on the form factor of the display. For example, larger displays may require the additional lighting components, while smaller displays may not require the additional lighting components.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A display, comprising:

a low profile backlighted display assembly forming a cabinet door or a picture frame, comprising:

a translucent display piece having a viewable surface and a perimeter;

a casing configured to conform generally to the perimeter of the display piece while exposing at least a portion of the viewable surface;

an illumination cavity configured within the casing and behind the viewable surface of the display piece; and a plurality of light emitting diodes (LEDs) located within the illumination cavity and configured to provide an essentially uniform back light illumination of the viewable surface, wherein:

the plurality of LEDs are configured to provide a non-uniform pattern density that compensates for a luminous intensity that decreases with increasing distance from the plurality of LED, the plurality of LEDs comprise first LEDs and second LEDs, the first LEDs and the second LEDs are positioned opposite each other, and configured to illuminate toward each other, within an illumination plane, and a first axis of illumination of the first LEDs is offset from a second axis of illumination of the second LEDs.

2. The display of claim 1 wherein a placement of the first LEDs is staggered relative to a placement of the second LEDs causing the first axis of illumination of the first LEDs to be offset from the second axis of illumination of the second LEDs.

3. The display of claim 1 wherein the first and second axes of illumination are essentially parallel to each other.

4. The display of claim 1 wherein the plurality of LEDs comprise at least first LEDs having a first emission angle and second LEDs having a second emission angle.

5. The display of claim 1 wherein the plurality of LEDs comprise at least first LEDs having a first luminous output and second LEDs having a second luminous output.

6. A display, comprising:

a low profile backlighted display assembly forming a cabinet door or a picture frame, comprising:

a translucent display piece having a viewable surface and a perimeter;

a casing configured to conform generally to the perimeter of the display piece while exposing at least a portion of the viewable surface;

an illumination cavity configured within the casing and behind the viewable surface of the display piece, wherein the illumination cavity includes an illumination perimeter that conforms generally to the perimeter of the display piece;

a plurality of light emitting diodes (LEDs) located within the illumination cavity and configured to provide an essentially uniform back light illumination of the viewable surface, the LEDs comprising first LEDs that emit perceptible white light and second LEDs that emit essentially only non-visible light, wherein:

at least some of the plurality of LEDs are fixed relative to one or more portions of the illumination perimeter to project light away from the illumination perimeter, and at least one of the plurality of LEDs is mounted at a non-perpendicular angle to the portion of the illumination perimeter to which it is affixed so as to enhance illumination uniformity, a passive element configured to provide backlight illumination of the viewable surface when excited by non-visible light emitted by the second LEDs.

* * * * *